United States Patent [19]

Waldhüter et al.

[11] 4,217,140

[45] Aug. 12, 1980

[54] METHOD AND APPARATUS FOR EXTRUSION PRESSING OF A GRANULATED, PREFERABLY POWDER-METALLURGIC MATERIAL

[75] Inventors: Werner Waldhüter, Stadtallendorf; Klaus Lichtinghagen, Kirchhain, both of Fed. Rep. of Germany

[73] Assignee: Glacier GmbH - DEVA Werke, Stadtallendorf, Fed. Rep. of Germany

[21] Appl. No.: 920,965

[22] Filed: Jun. 30, 1978

[30] Foreign Application Priority Data

Jul. 21, 1977 [DE] Fed. Rep. of Germany ..... 2733009

[51] Int. Cl.[2] ..... B27F 5/00

[52] U.S. Cl. ..... 75/214; 425/79; 425/114; 425/174.8 R; 425/325; 75/200

[58] Field of Search ..... 425/79, 114, 174.8 R, 425/325; 75/214, 200

[56] References Cited

U.S. PATENT DOCUMENTS

| | | | |
|---|---|---|---|
| 2,834,674 | 5/1958 | Silvasy et al. | 75/214 |
| 3,122,434 | 2/1964 | Reed et al. | 75/214 |
| 4,025,337 | 5/1977 | Woodburn et al. | 75/214 |
| 4,030,919 | 6/1977 | Lea | 75/214 |

*Primary Examiner*—Brooks H. Hunt

*Attorney, Agent, or Firm*—Oblon, Fisher, Spivak, McClelland & Maier

[57] ABSTRACT

A high density extruded product is continuously produced in a one step operation by first cold compressing granulated powder material in a bore into a pellet by means of a plunger reciprocable into the bore, then pushing it by the force of succeeding pellets further down the bore into a hot press zone where the pellet is sintered, and finally pushing it through an uncooled orifice into a cooling zone. The hot press zone may be heated by means of an induction heating coil. The die may be made up of a plurality of interchangable die pieces.

14 Claims, 2 Drawing Figures

20
22
19
1
4
3
3
5
2
6
20
21
27
26
23
24
25
15
16
18
18

METHOD AND APPARATUS FOR EXTRUSION PRESSING OF A GRANULATED, PREFERABLY POWDER-METALLURGIC MATERIAL

BACKGROUND OF THE INVENTION

1. Field of the Invention

The invention relates to a method and apparatus for extrusion pressing a granulated, preferably powder-metallurgic material, where the material is fed into a cavity, cold-compressed thereby means of a plunger, then sintered by heating and forced through a die.

2. Description of the Prior Art

It is known that one may compress powder-metallurgic materials so that the pellets are first compressed in suitable forms which are then subjected to a following cold or hot extrusion (cf, e.g. Laue/Staenger "Strangpressen. Verfahren-Maschinin-Werkzeuge" [Extruding Presses. Methods-Machines-Tools]. Duseeldorf, 1976 p. 179/180, Section 3.6). It is also known that one may use, instead of such pellets, dose-like containers full of powder which are simultaneously solidified in and pressed out of the containers (cf. e.g. DT-PS 1 758 540). Commonly in this method, before the extrusion process, an intermediate mass (a compressed pellet with or without a hull) must first be formed and only then can an extrusion pressing be carried out in a process physically separate from the intermediate mass forming process. Moreover, when a pellet with a hull is used, it is also necessary to remove the hull after pressing out the pellet.

The forming of rods from powder mixed with plasticizing agents by means of a die is likewise known. The use of the plasticizing agent leads, of course, to a reduction in powder density, where this added agent can wholly or partially vanish during the sintering process, with formation of undesired spaces between the powder grains and resulting effects on the mechanical properties of the product.

Also known is the extrusion pressing of heated powder whereby an end product with good material characteristics can indeed be obtained, although the high temperature utilized places great stress on the tools and creates difficulties in maintaining close tolerances and smooth surfaces. Such methods are therefore not very economical.

No known method has succeeded so far in producing from powder or granules a direct extrusion to a continuous rod with satisfactory properties and economy. Moreover, current practice in the production of prepressed pellets or even of ringlike parts is possible only on hydraulic presses in tools which limit the production length. Such lengths at present are about 103 mm at most. However, even at this relatively short length the desired internal uniformity of the product is prevented by the taper effect and friction losses in the pressing process. This also leads to the result that, in very highly stressed parts, only product lengths of about 50 to 53 mm are used, and in no case, however, is the ratio of 3 times the wall thickness exceeded.

SUMMARY OF THE INVENTION

Accordingly, it is an object of the present invention to develop an improved method and apparatus of the type mentioned above such that, while largely avoiding the indicated drawbacks of the state of the art, they permit a direct and uninterrupted working of powder mixtures to a continuous rod with properties comparable to what can be achieved otherwise only by hot-press methods, with simultaneously economical production.

This problem is solved by the invention using a method in which the granulated raw material is continually fed into a cavity, and compressed to a pellet by repetitive plunger strokes. The resulting pellet is then forced into a hot-press zone immediately adjoining the cavity under the pressure of the compression stroke which is forming the following pellet, and, pushed by the pressure of the pellets continually shoved out of the cavity, it is sintered while passing through the hot-press zone to the die element. The method of the invention is the first to make possible the production of rod material of arbitrary length. Inside the resultant extrusion there is at every point a comparatively high degree of compaction and simultaneously a relatively great uniformity of the technological characteristics of the material along the entire extrudate. The method of the invention permits the direct cold and hot pressing of the granules within a single device in one step beginning with a powder mixture, so that the production of pellets, the sintering, and the extrusion pressing need not be undertaken as separate process steps. In the method of the invention, the continuously-fed granulated material is compressed by the plunger in the upper part of a device, where the back pressure for the compression is created by the total friction within the entire extruding press device. Here the friction over the length of the cavity itself also contributes. The pellets thus produced are then pushed one after another into the immediately adjoining sintering zone. Thus, the actual compression is first carried out in the cold state, as is also the case where hydraulic compression is used for producing the pellets. The pellets forced into the heating zone are there raised to a temperature of 600° to 700° C. which may vary depending upon the material being compacted. The diffusion process then takes place with further compression of the material. Simultaneously the process is also effected by the wall friction and the friction resistance in the extrudate against the continual compression of the pellets. After traversing the sintering zone the diffused extrusion material is then forced through the die element orifice whereby it is additionally compressed or permitted to expand and develops a clean smooth surface.

Preferably the hot press zone has the same cross section as the cavity exit. The distance through it is preferably 120 mm.

Another advantageous feature of the method of the invention is that the heating of the extrusion material in the hot-press zone is done inductively. A medium frequency is recommended for this, with the exact medium frequency chosen to suit the composition of the material used. For materials with bronze matrix, e.g., the use of a medium frequency of about 10 KHz is preferred.

The average extrusion rate strongly influences the degree of compaction and the technical data of the final product. It has been found that the most favorable and economical values can be obtained with an average extrusion rate of 1.2 m/hr.

In the method of the invention it is recommended that the granulated material be fed in by use of an automatic filler scoop, whereby an especially uniform continual replenishment of the cavity is assured.

Since the die is not directly cooled, the extrusion of a granular material which has been heated in the hot-press zone to a temperature between 650° and 700° C., for example, exhibits an exit temperature of about 550° C. Advantageously, the extrudate from the die element is passed through an adjoining cooling zone. It is recommended that direct contact with the cooling element be avoided so that only the circulating air does the cooling. This corresponds to a heat treatment in which the material can relieve its stresses, whereby an especially great uniformity is achieved in the resultant extrusion.

The method of the invention is usable likewise for the production of massive and hollow extrusions. The profile of the resultant extrusion here depends on the shape of the cold compression cavity and that of the die. Together with round, square or angular forms, all sorts of hollow profiles, tubes in particular, can also be produced by the method of the invention.

The method of the invention is especially suited for the extrusion pressing of granulated materials with metallic matrix. But it is likewise quite useful for extruding a granulated material with chemically produced matrix materials instead of a metallic one, perhaps one from the polysiloxane or polyimide groups which must also be worked by powder-metallurgic methods.

The invention relates further to an apparatus for extrusion pressing a granulated, preferably powder-metallurgic material, with an intake device for feeding in the granules, a pressing plunger for cold compression of the granules in a cavity connected with the intake device, a hot-press section for sintering the cold-compressed material and a die element. The arrangement of the invention is characterized by the fact that the hot-press section acts as the hind portion of the cavity (viewed in the direction of extrusion), and that the die element has an uncooled orifice terminating the hot-press section at its exit.

Since the orifice itself is not to be cooled, a suitable choice of material for the orifice is very important. A NiCrCo-alloy is recommended since such alloys are particularly heat-resistant.

Another advantageous feature of the invention is that an induction arrangement (coil) is provided for heating the extrusion material along the hot-press section, so that the material is self-heating, thus permitting a particularly cool outer tool surface.

A further positive feature of the invention is that the die element exhibits several exchangeable orifices arranged one behind another thus assuring rapid interchangability of orifices within the heated cavity.

In a comparison test of the hot-pressing of two different granulated materials versus their extrusion pressing by the method of the invention under otherwise identical conditions, the valves shown in Table 1 were obtained.

TABLE 1

| ALLOY | MATERIAL 1 | | MATERIAL 2 | |
|---|---|---|---|---|
| Production Method | hot-pressed | method of invention | hot-pressed | method of invention |
| Density (kp/mm2) | 93% | 95% | 92% | 95% |
| Brinell hardness | 70 ± 10 | 70 ± 10 | 50 ± 15 | 60 ± 5 |
| Compressive strength (kp/mm2) | 40 ± 4 | 44 ± 1.5 | 28 ± 3 | 31 ± 1 |
| Tensile strength (kp/mm2) | 8.5 ± 0.5 | 9 ± 0.3 | 3.5 ± 0.5 | 10.5 ± 0.5 |

(Extrusion length 120 mm)

As can be seen from Table 1, the extrusions pressed out using the method of the invention showed improved values in both alloys over those for extrusions produced by a common hot-press method with respect to density, compressive strength, and tensile strength, and additionally, in one of the materials, there is also considerable increase in Brinell hardness.

The advantageous technological properties of the extrudates attainable with the method of the invention are readily apparent from the indicated table.

Along with the improvement in the technological properties, however, utilization of the method of the invention also offers much greater economy in production. Thus, in a comparison test based on a normal day's output of a hydraulic press using a standard hot-press method, a day's output of a comparison material of nominal diameter of 16 mm achieved on the hydraulic press by this known method (production by hydraulic pressing) was increased by more than 2.5 times using the extruding-press method of the invention. The resulting production cost per kg could thus be reduced by almost 50% through use of the method of the invention.

BRIEF DESCRIPTION OF THE DRAWINGS

Various other objects and many of the attendant advantages of the present invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
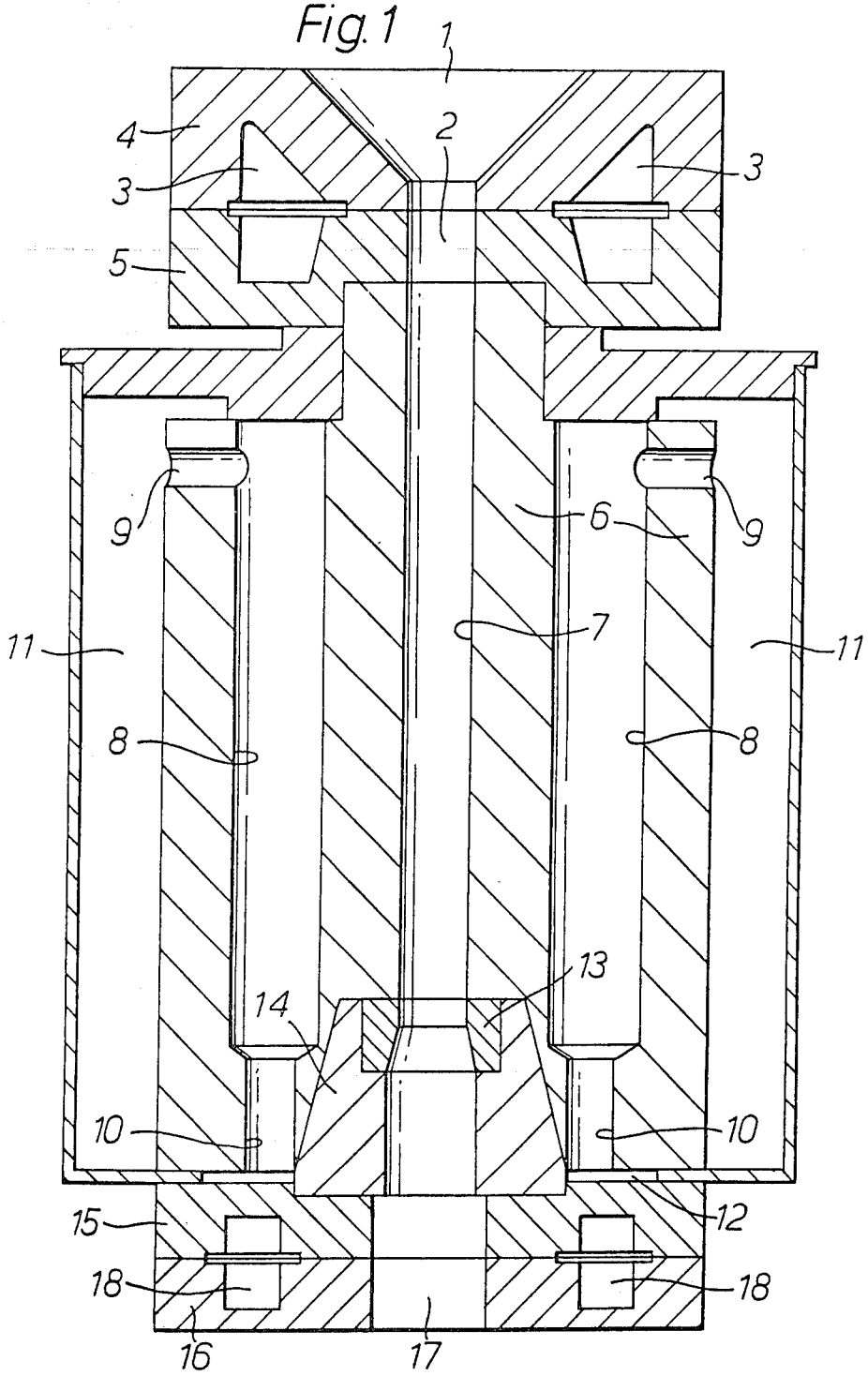
FIG. 1 shows a main view in cross section of a device conforming to the invention.

The device of FIG. 1 has at the top a conical hopper 1 which opens downwards into a round hole 2 forming the cavity, as well as cooling passages 3 going around through the wall of both the hopper 1 and the cavity 2 in order to assure the desired cold compression in pellet production. The cooling in this region has the additional task of preventing oxidation of the uncompressed powder and further oxidation in the separation plane by the action of elevated temperatures.

In the arrangement of FIG. 1, the hopper 1 and cavity 2 are formed in two tool parts 4 and 5 which fit together and are suitably fastened to one another to constitute the input portion of the overall device. The unit composed of parts 4 and 5 sits on a part 6, in which there is a central bore 7 in direct connection with the hole 2 of the cavity and of the same cross section. Around the wall of the bore 7 there is a concentric annular space to receive a heating medium or a heating device (like an induction coil). One could also, however, use a multiplicity of borings 8 parallel to the axis of the bore 7 (FIG. 1 shows the case of separate borings). The borings 8 or the annular space can connect via passages 9 in the tool part 6 to an annular passage 11 around the outside of tool part 6 and via passages 10 to an annular slot in tool part 6, by means of which a flowing heating medium is supplied to the borings or the annular space and carried off as it cools during the process. A hot gas, or steam under high pressure, can preferably be used here as the heating medium. However, it might be especially desirable to use an induction coil in the annular space (as shown in connection with FIG. 2) as the heating device. The central hole 7 in tool part 6, in the section of the overall device surrounded outwardly by the heating jacket, is the hot-press and sintering zone.

At the lower end of the hot-press passage formed by the hole 7 there is a die element with an orifice 13 adjustable by means of a holder 14. The die element 13 provides final sizing of the product and can permit a larger diameter for the product. The die element is in contact with a cooling arrangement formed of two joined pieces 15 and 16 with a central boring 17 of diameter greater than the exit diameter of the orifice 13 or the central outlet passage in the holder 14. This prevents the finished extrudate exiting the orifice 13, and the holder 14, from contacting the wall of the central boring in the cooling arrangement formed from parts 15 and 16. In the embodiment illustrated for the cooling device an annular passage 18 is arranged concentrically about the central boring 17 in which the desired coolant can circulate.

Figure 2:
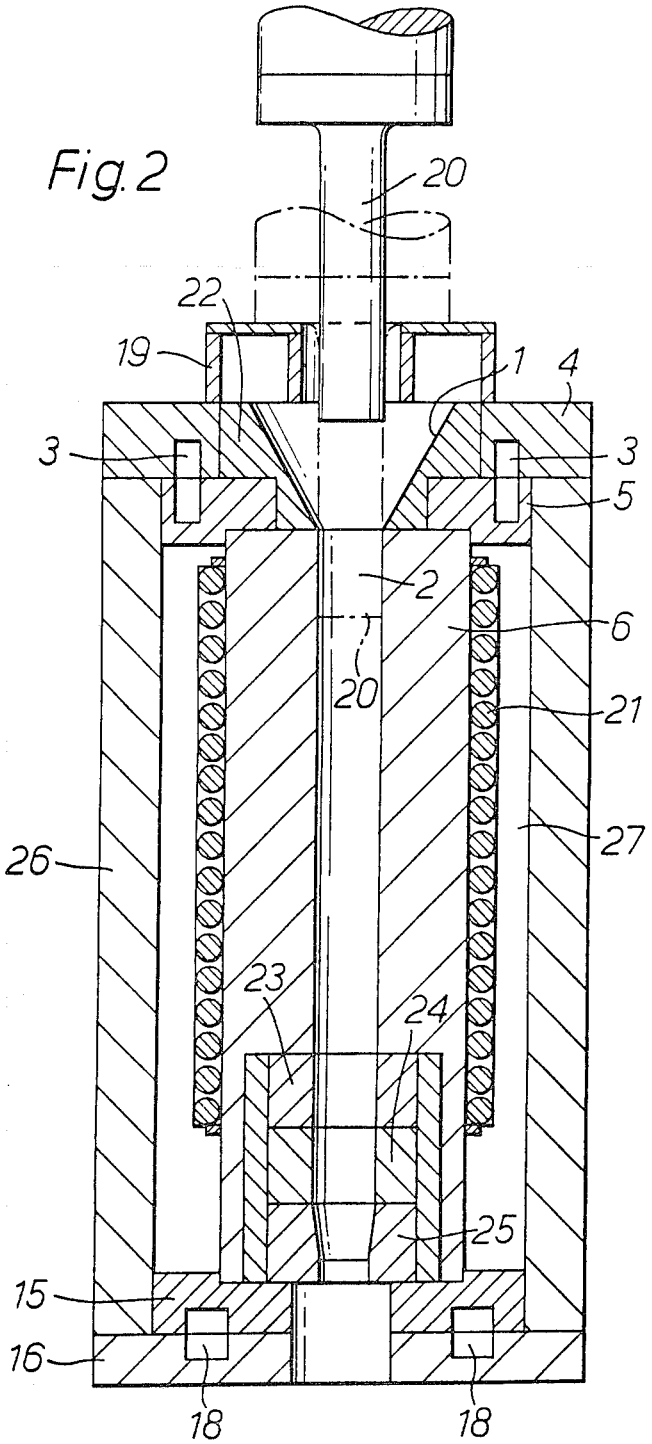
FIG. 2 shows a main cross-sectional view of a second embodiment of a device for carrying out the method of the invention exhibiting a die element with several exchangeable orifices.

In the embodiment of a device conforming to the invention shown in FIG. 2, parts corresponding to or performing analogous functions to those of FIG. 1 are given the same reference numbers.

Here again a filling hopper 1 is provided on the input end which is continually fed from above with fresh granules by an automatic loading chute 19. Central to hopper 1 is a pressing plunger 20, which was not shown in FIG. 1 but is meant to be used in that device. This plunger is continually operated from above (indicated by solid lines in FIG. 2). Each time the lower end of the plunger reaches the hopper, as the plunger is raised, it permits a sideways rush of granules into the central cavity boring 2 and thus refills this cavity. As soon as plunger 20 reaches its upper position, its motion is reversed and it is again forced down into the boring of cavity 2. Thus the granules there and in the hopper beneath the plunger are compressed downward in the cavity to produce a raw pellet which is jammed down on the just previously formed pellet, which in turn is jammed down on the pellet preceding it, etc.

With the compression of the granules in the cavity 2, by the descent of the plunger 20 and the consequent production of a pellet, the latter is simultaneously shoved against the pellet already shoved ahead of it in the direction of the tool outlet. By the continual up and down motion of the plunger 20 and the resultant repetitive production of raw pellets there is thus formed a stepwise progression of the prepressed material through the entire device. In contrast to the representation in FIG. 1, in the device of FIG. 2, the cavity boring 2 does not begin in the tool part containing the hopper 1 but only in the tool part 6 next to the hopper 1. It runs through the entire part 6, being surrounded over most of its length from the top of part 6, where the hopper 1 sits, to its lower end (where the die element is located) by an induction coil 21, concentric with it at a certain radial distance. The funnel-shaped hopper 1, at the upper end of part 6, is formed within a part 22 which in turn is surrounded and held by an arrangement consisting of parts 4 and 5, as well as being coolable from the outside by cooling passages 3 therein. In the device shown in FIG. 2, the upper portion of the central boring 2 in tool part 6, in which the compaction of the granules and the production of raw pellets proceeds without heating, passes directly into the portion of the boring provided for the hot-pressing and sintering which is surrounded by the induction coil within which the passing extrusion material is heated. At the end of the tool part 6 is a die element, here with three successive, individually exchangeable orifices 23, 24 and 25, the last one of which (orifice 25) exhibits a decreasing diameter. Below this final orifice is located the output cooling arrangement of two joined parts 15 and 16 with concentric cooling passage 18 having a cross section of its inner boring 17 enlarged as compared with the outlet cross section of final orifice 25. In this way, again, it is assured that the final-size endless extrusion coming from the last orifice 25, with a die-set compression occurring even there, does not come into contact with the wall of the cooling arrangement, so that it is cooled only by the air circulating around it. In this manner a heat treatment is achieved in which a complete unstressing of the material can take place, resulting in especially high uniformity of the material.

The devices illustrated in FIGS. 1 and 2 are designed for making solid extrusions. In a completely analogous manner, however, hollow extrusions, e.g. tubular cross sections, can be obtained if appropriate orifices are used in conjunction with the appropriate changes in the cavity required for the creation of hollow cross sections.

An annular air slot 27 between the induction coil 21 and the outer wall 26 of the device enables keeping the latter relatively cool in spite of the extrusion heating.

In operation of the devices shown in FIG. 1 or FIG. 2, the precompacted pellets formed at each stroke of the plunger 29 are stepwise pushed continuously one after another into the heating zone within the tool part 6. Under the pressure of the continual succession of pellets, a slow traversal of the heating zone takes place until the die-element orifices are reached. While the creation of the raw pellets is by a cold process, here continuously increasing compaction under simultaneously continuously rising temperature (about 650° to 700° C.) is achieved by the immediate passage into the heating zone and, under the pressure of the following pellets, by the thermal expansion occurring there as well as by the wall friction effective throughout, whereby the diffusion processes necessary for the desired sintering can take place. The average rate at which the extrudate is forced through the entire device is of great significance here, particularly with regard to the technological data of the resultant extrudate. It has been found that the use of average extrusion rates in the range from 1.2 to 1.5 m/hr gives especially good values, with the lower limit given here being optimal for many materials. The utilization of several orifices, as in the device of FIG. 2, makes possible also, even with the heated cavity, a rapid change of individual orifices with no difficulty. Since the orifices themselves are not cooled, it is recommended that they be made of good heat-resistance alloys, e.g., nickel-chromium-cobalt alloys.

Extrudable materials may be directly processed, in particular, granulated metallic substance with solid lubricant components, as well as chemically produced matrix-substances with solid lubricant admixtures. The extrudates produced exhibit exceedingly great uniformity everywhere as well as remarkably good technological properties. The production of continuously generated extrudate in simply constructed compact devices with the method and apparatus of the invention assures particularly good economy.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. Method for the extrusion molding of a granular, powdered metallurgic material, whereby said material is continuously fed into a continuous press mold where it is precompacted in a cold process by means of continual strokes of a plunger against the frictional resistance built up by a section of an already compressed rod, pushed through said press mold by the pressure of the subsequent stroke of the plunger and sintered in said press mold, wherein a constant plunger stroke is utilized, the material being immediately heated for sintering during its press mold passage and subsequent to its cold pre-compaction and being sintered during the remaining passage through said press mold and as far as a die from which it is continually extruded.

2. A method as in claim 1, characterized by the fact that the pellet passes through the length of the hot-press zone of about 120 mm.

3. A method as in claim 1, characterized by the fact that an average extrusion rate of 1.2 m/hr is used.

4. A method as in claim 1, characterized by the fact that the granules are fed in by means of an automatic filler chute.

5. A method as in claim 1, characterized by the fact that the extrusion material after passing through the die element traverses a following attached cooling section.

6. A method of claim 1 for extrusion pressing of ferrous materials.

7. A method as in claim 1 for extrusion pressing of oxidic materials.

8. A method as in claim 1 for extrusion pressing of nonmetallic materials, in particular plastics or chemically produced matrix materials with solid-lubricant admixtures.

9. A method as in claim 1, characterized by the fact that the heating of the extrusion material in the hot-press zone is done inductively.

10. A method as in claim 9, characterized by the fact that the heating of the extrusion material is by medium-frequency induction heating.

11. A method as in claim 10 where the material has bronze matrix, and the medium frequency used is 10 kHz.

12. Device for the extrusion molding of a granular, powdered metallurgic material, with a feeding device to accept the granular substance, a plunger for the pre-compaction in a cold process of the granular substance in the press-mold passage, a press mold passage arranged downstream from the feeding device and including a heating device to heat the rod of material for the purpose of sintering within the press mold passage, wherein the heating device for the heating of the rod of material is provided beginning at a distance from the inlet of the press mold passage which corresponds to approximately the constant plunger depth inside the press mold, said heating device reaching as far as at least one uncooled die at the outlet of the press mold passage.

13. An apparatus as in claim 12, characterized by the fact that the orifice is of a NiCrCo-alloy.

14. An apparatus as in claim 12 characterized by the fact that an induction coil is provided along the hot-press section as the heating device for the extrusion material.

* * * * *